US007464770B2

(12) United States Patent
Jones et al.

(10) Patent No.: US 7,464,770 B2
(45) Date of Patent: Dec. 16, 2008

(54) CLOSED-LOOP CONTROL OF HYDRAULIC PRESSURE IN A DOWNHOLE STEERING TOOL

(75) Inventors: Stephen Jones, Cypress, TX (US); Junichi Sugiura, Houston, TX (US)

(73) Assignee: PathFinder Energy Services, Inc., Houston, TX (US)

( * ) Notice: Subject to any disclaimer, the term of this patent is extended or adjusted under 35 U.S.C. 154(b) by 64 days.

(21) Appl. No.: 11/595,054

(22) Filed: Nov. 9, 2006

(65) Prior Publication Data

US 2008/0110674 A1 May 15, 2008

(51) Int. Cl.
*E21B 21/08* (2006.01)
*E21B 7/04* (2006.01)

(52) U.S. Cl. ..... 175/25; 175/24; 175/26; 175/61; 175/92

(58) Field of Classification Search ..... 175/24, 175/25, 61

See application file for complete search history.

(56) References Cited

U.S. PATENT DOCUMENTS

| | | | | |
|---|---|---|---|---|
| 2,373,880 | A | 4/1945 | Driscoll | |
| 2,603,163 | A | 7/1952 | Nixon | |
| 2,874,783 | A | 2/1959 | Haines | |
| 2,880,805 | A | 4/1959 | Nelson et al. | |
| 2,915,011 | A | 12/1959 | Hamill | |
| 4,407,374 | A | 10/1983 | Wallussek et al. | |
| 4,416,339 | A | 11/1983 | Baker et al. | |
| 4,463,814 | A | 8/1984 | Horstmeyer et al. | |
| 4,844,178 | A | 7/1989 | Cendre et al. | |
| 4,947,944 | A | 8/1990 | Coltman et al. | |
| 4,957,173 | A | 9/1990 | Kinnan | |
| 5,070,950 | A | 12/1991 | Cendre et al. | |
| 5,168,941 | A | 12/1992 | Krueger et al. | |
| 5,341,886 | A | 8/1994 | Patton | |
| 5,603,386 | A | 2/1997 | Webster | |
| 5,797,453 | A | 8/1998 | Hisaw | |
| 5,941,323 | A | 8/1999 | Warren | |
| 6,148,933 | A | 11/2000 | Hay et al. | |
| 6,158,529 | A | 12/2000 | Dorel | |
| 6,233,564 | B1 | 5/2001 | Harrell et al. | |
| 6,257,356 | B1 * | 7/2001 | Wassell | 175/61 |
| 6,290,003 | B1 | 9/2001 | Russell | |
| 6,427,783 | B2 | 8/2002 | Krueger et al. | |
| 6,609,579 | B2 | 8/2003 | Krueger et al. | |
| 6,761,232 | B2 | 7/2004 | Moody et al. | |

(Continued)

FOREIGN PATENT DOCUMENTS

| | | | |
|---|---|---|---|
| EP | 1174582 | A3 | 1/2002 |

(Continued)

*Primary Examiner*—David J. Bagnell
*Assistant Examiner*—Brad Harcourt

(57) ABSTRACT

Aspects of this invention include a steering tool having a controller configured to provide closed-loop control of hydraulic fluid pressure. In one exemplary embodiment, closed-loop control of a system (reservoir) pressure may be provided. In another embodiment, closed-loop control of a blade pressure may be provided while the blade remains substantially locked at a predetermined position. Other exemplary embodiments may incorporate rule-based-intelligence such that pressure control thresholds may be determined based on various measured and/or predetermined downhole parameters. The invention tends to reduce the friction (drag) between the blades and the borehole wall and thereby also tends to improve drilling rates. Moreover, the invention also tends to improve the service life and reliability of downhole steering tools.

25 Claims, 6 Drawing Sheets

U.S. PATENT DOCUMENTS

| | | | |
|---|---|---|---|
| 2001/0042643 | A1 | 11/2001 | Krueger et al. |
| 2006/0185902 | A1 | 8/2006 | Song et al. |

FOREIGN PATENT DOCUMENTS

| | | | |
|---|---|---|---|
| WO | WO-98/34003 | A1 | 8/1998 |
| WO | WO-00/28188 | A1 | 5/2000 |
| WO | WO-01-51761 | A1 | 7/2001 |
| WO | WO-03-097989 | A1 | 11/2003 |

* cited by examiner

CLOSED-LOOP CONTROL OF HYDRAULIC PRESSURE IN A DOWNHOLE STEERING TOOL

RELATED APPLICATIONS

None.

FIELD OF THE INVENTION

The present invention relates generally to downhole tools, for example, including directional drilling tools such as three-dimensional rotary steerable tools (3DRS). More particularly, embodiments of this invention relate to closed-loop control and rule-based intelligence methods for controlling hydraulic pressure in a downhole steering tool.

BACKGROUND OF THE INVENTION

Directional control has become increasingly important in the drilling of subterranean oil and gas wells, for example, to more fully exploit hydrocarbon reservoirs. Downhole steering tools, such as two-dimensional and three-dimensional rotary steerable tools, are commonly used in many drilling applications to control the direction of drilling. Such steering tools commonly include a plurality of force application members (also referred to herein as blades) that may be independently extended out from and retracted into a housing. The blades are disposed to extend outward from the housing into contact with the borehole wall. The direction of drilling may be controlled by controlling the magnitude and direction of the force or the magnitude and direction of the displacement applied to the borehole wall. In rotary steerable tools, the housing is typically deployed about a shaft, which is coupled to the drill string and disposed to transfer weight and torque from the surface (or from a mud motor) through the steering tool to the drill bit assembly.

In general, the prior art discloses two types of directional control mechanisms employed with rotary steerable tool deployments. U.S. Pat. Nos. 5,168,941 and 6,609,579 to Krueger et al disclose examples of rotary steerable tool deployments employing the first type of directional control mechanism. The direction of drilling is controlled by controlling the magnitude and direction of a side (lateral) force applied to the drill bit. This side force is created by extending one or more of a plurality of ribs (referred to herein as blades) into contact with the borehole wall and is controlled by controlling the pressure in each of the blades. The amount of force on each blade is controlled by controlling the hydraulic pressure at the blade, which is in turn controlled by proportional hydraulics or by switching to the maximum pressure with a controlled duty cycle. Krueger et al further disclose a hydraulic actuation mechanism in which each steering blade is independently controlled by a separate piston pump. A control valve is positioned between each piston pump and its corresponding blade to control the flow of hydraulic fluid from the pump to the blade. During drilling each of the piston pumps is operated continuously via rotation of a drive shaft.

U.S. Pat. No. 5,603,386 to Webster discloses an example of a rotary steerable tool employing the second type of directional control mechanism. Webster discloses a mechanism in which the steering tool is moved away from the center of the borehole via extension (and/or retraction) of the blades. The direction of drilling may be controlled by controlling the magnitude and direction of the offset between the tool axis and the borehole axis. The magnitude and direction of the offset are controlled by controlling the position of the blades.

In general, increasing the offset (i.e., increasing the distance between the tool axis and the borehole axis) tends to increase the curvature (dogleg severity) of the borehole upon subsequent drilling. Webster also discloses a hydraulic mechanism in which all three blades are controlled via a single pump and pressure reservoir and a plurality of valves. In particular, each blade is controlled by three check valves. The nine check valves are in turn controlled by eight solenoid controlled pilot valves. Commonly assigned, co-pending U.S. patent application Ser. No. 11/061,339 employs hydraulic actuation to extend the blades and a spring biased mechanism to retract the blades. Spring biased retraction of the blades advantageously reduces the number of valves required to control the blades. The '339 application is similar to the Webster patent in that only a single pump and/or pressure reservoir is required to actuate the blades.

The above described steering tool deployments are known to be commercially serviceable. Notwithstanding, there is room for improvement of such tool deployments. For example, there is a need for a steering tool having an improved hydraulic control mechanism. In particular, as described in more detail below, there is a need for improved hydraulic control in steering tools employing the second type of directional control mechanism.

SUMMARY OF THE INVENTION

The present invention addresses the need for an improved hydraulic control mechanism in downhole steering tools such as rotary steerable tools. Aspects of this invention include a steering tool having a controller configured to provide closed-loop control of hydraulic fluid pressure. For example, in one exemplary embodiment, closed-loop control of a system (reservoir) pressure may be provided. In another embodiment, closed-loop control of a blade pressure may be provided while the blade remains substantially locked at a predetermined position. In certain advantageous embodiments, pressure control thresholds may be determined based on various downhole parameter measurements, for example, including borehole inclination, gravity tool face, borehole curvature (e.g., the change in inclination or azimuth with measured depth), blade friction and/or one or more performance metrics of the tool, for example, including blade reset frequency.

Exemplary embodiments of the present invention may advantageously provide several technical advantages. For example, exemplary embodiments of this invention enable system and/or blade pressures to be controllably reduced during certain drilling conditions. This reduction in pressure tends to reduce the friction (drag) between the blades and the borehole wall and thereby tends to improve drilling rates. The use of certain embodiments of the invention may thus result in significant cost savings for the directional driller (owing to a reduction in rig time required to complete a drilling job).

Reduced system and/or blade pressure also tends to reduce the stress on seals and various other hydraulic components, which in turn tends to improve the service life and reliability of the steering tool. Reducing the friction between the blades and the borehole wall also tends to reduce ware and other damage to the blades and blade pistons.

In one aspect the present invention includes a downhole steering tool configured to operate in a borehole. The steering tool includes a plurality of blades deployed on a steering tool housing. The blades are disposed to extend radially outward from the housing and engage a wall of the borehole, the engagement of the blades with the borehole wall operative to eccenter the housing in the borehole. The steering tool also includes a hydraulic module including (i) a plurality of valves, (ii) a fluid chamber disposed to provide high pressure fluid to each of the plurality of blades (the high pressure fluid operative to extend the blades), and (iii) at least one pressure sensor disposed to measure a pressure in the fluid chamber. A controller is disposed to (i) receive pressure measurements from the sensor and (ii) regulate the pressure in the fluid chamber via actuating and de-actuating at least one of the valves in response to said pressure measurements.

In another aspect this invention includes a downhole steering tool configured to operate in a borehole. The steering tool includes a plurality of blades deployed on a steering tool housing. The blades are disposed to extend radially outward from the housing and engage a wall of the borehole, the engagement of the blades with the borehole wall operative to eccenter the housing in the borehole. The steering tool also includes a hydraulic module including a plurality of valves and a fluid chamber disposed to provide pressurized fluid to each of the plurality of blades. The pressurized fluid is operative to extend the blades. Each of the blades includes at least a first valve in fluid communication with high pressure fluid and at least a second valve in fluid communication with low pressure fluid. Each of the blades further includes a pressure sensor disposed to measure a fluid pressure in the blade. A controller is disposed (i) to receive pressure measurements from the pressure sensors and (ii) reduce the pressure in at least one of the blades via opening at least one of the corresponding first and second valves when the measured pressure is greater than a threshold pressure.

In another aspect the present invention includes a closed-loop method for regulating hydraulic pressure in a downhole steering tool. The steering tool typically includes a plurality of blades disposed to extend radially outward from a housing and engage a wall of a borehole. The steering tool typically further includes a hydraulic module operative to extend the blades. The closed-loop method includes deploying the steering tool in a subterranean borehole and extending each of the blades to a corresponding predetermined radial position. The method further includes receiving at least one control parameter, the control parameter a member of the group consisting of borehole parameters and steering tool parameters and processing the control parameter to determine at least one pressure threshold. The method still further includes measuring a fluid pressure in the hydraulic module, comparing the measured fluid pressure with the pressure threshold, and opening at least one valve when the measured fluid pressure is greater than the pressure threshold.

The foregoing has outlined rather broadly the features of the present invention in order that the detailed description of the invention that follows may be better understood. Additional features and advantages of the invention will be described hereinafter which form the subject of the claims of the invention. It should be appreciated by those skilled in the art that the conception and the specific embodiments disclosed may be readily utilized as a basis for modifying or designing other methods, structures, and encoding schemes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages therefore, reference is now made to the following descriptions taken in conjunction with the accompanying drawings, in which.

DETAILED DESCRIPTION

Figure 1:
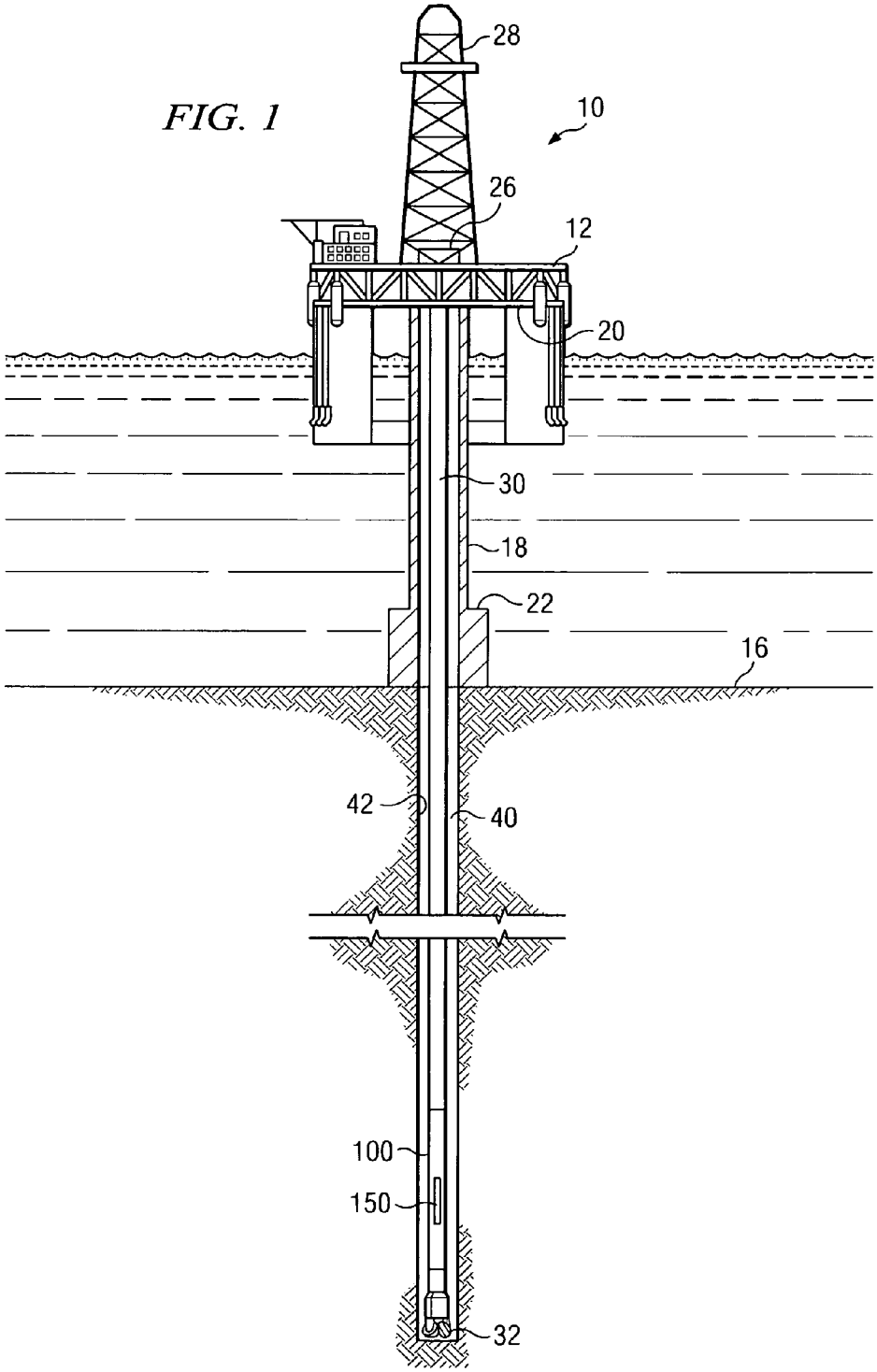
FIG. 1 depicts a drilling rig on which exemplary embodiments of the present invention may be deployed.

Referring first to FIGS. 1 through 3B, it will be understood that features or aspects of the embodiments illustrated may be shown from various views. Where such features or aspects are common to particular views, they are labeled using the same reference numeral. Thus, a feature or aspect labeled with a particular reference numeral on one view in FIGS. 1 through 3B may be described herein with respect to that reference numeral shown on other views.

FIG. 1 illustrates a drilling rig 10 suitable for utilizing exemplary downhole steering tool and method embodiments of the present invention. In the exemplary embodiment shown on FIG. 1, a semisubmersible drilling platform 12 is positioned over an oil or gas formation (not shown) disposed below the sea floor 16. A subsea conduit 18 extends from deck 20 of platform 12 to a wellhead installation 22. The platform may include a derrick 26 and a hoisting apparatus 28 for raising and lowering the drill string 30, which, as shown, extends into borehole 40 and includes a drill bit 32 and a steering tool 100 (such as a three-dimensional rotary steerable tool). In the exemplary embodiment shown, steering tool 100 includes a plurality of blades 150 (e.g., three) disposed to extend outward from the tool 100. The extension of the blades 150 into contact with the borehole wall is intended to eccenter the tool in the borehole, thereby changing an angle of approach of the drill bit 32 (which changes the direction of drilling). Exemplary embodiments of steering tool 100 further include hydraulic 130 and electronic 140 control modules (FIG. 2) configured to provide closed-loop control of system and/or blade hydraulic pressures. Drill string 30 may further include a downhole drilling motor, a mud pulse telemetry system, and one or more additional sensors, such as LWD and/or MWD tools for sensing downhole characteristics of the borehole and the surrounding formation. The invention is not limited in these regards.

It will be understood by those of ordinary skill in the art that methods and apparatuses in accordance with this invention are not limited to use with a semisubmersible platform 12 as illustrated in FIG. 1. This invention is equally well suited for use with any kind of subterranean drilling operation, either offshore or onshore. While exemplary embodiments of this invention are described below with respect to rotary steerable embodiments (e.g., including a shaft disposed to rotate relative to a housing), it will be appreciated that the invention is not limited in this regard. The invention is equally well suited for use with substantially any suitable downhole steering tools that utilize a plurality of blades to eccenter the tool in the borehole.

Figure 2:
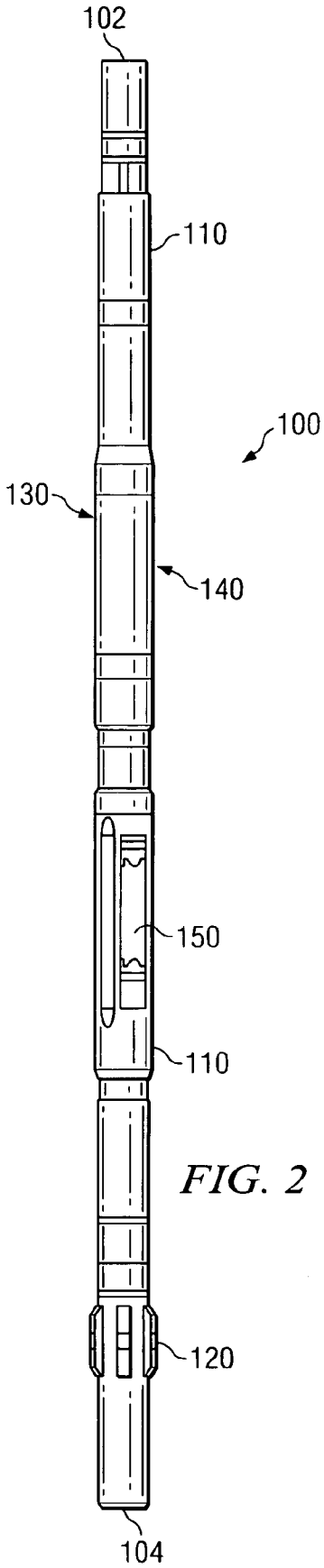
FIG. 2 is a perspective view of one exemplary embodiment of the steering tool shown on FIG. 1.
Figure 3A:
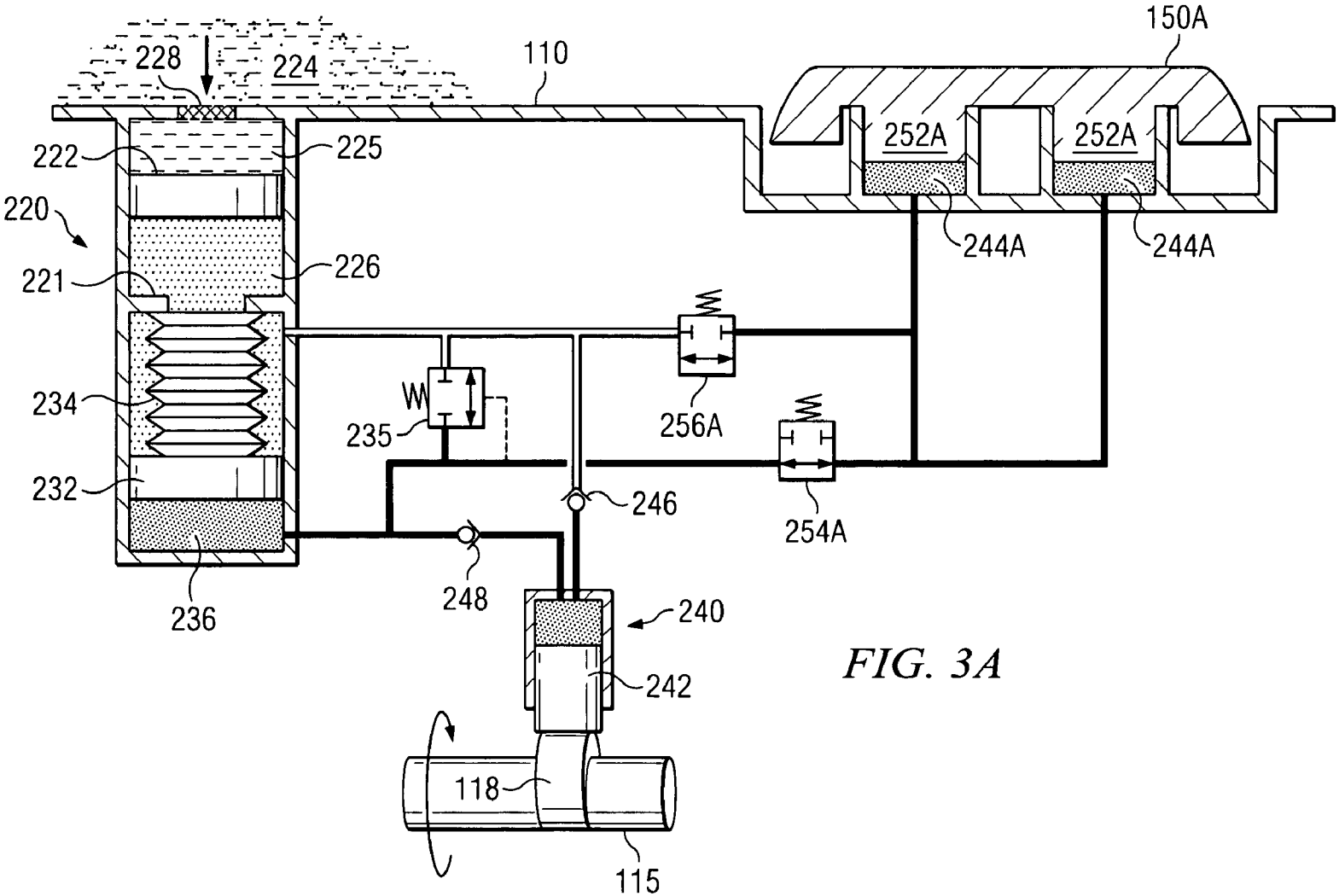
FIGS. 3A and 3B depict schematic diagrams of an exemplary hydraulic control module employed in exemplary embodiment of the steering tool shown on FIG. 2.
Figure 3B:
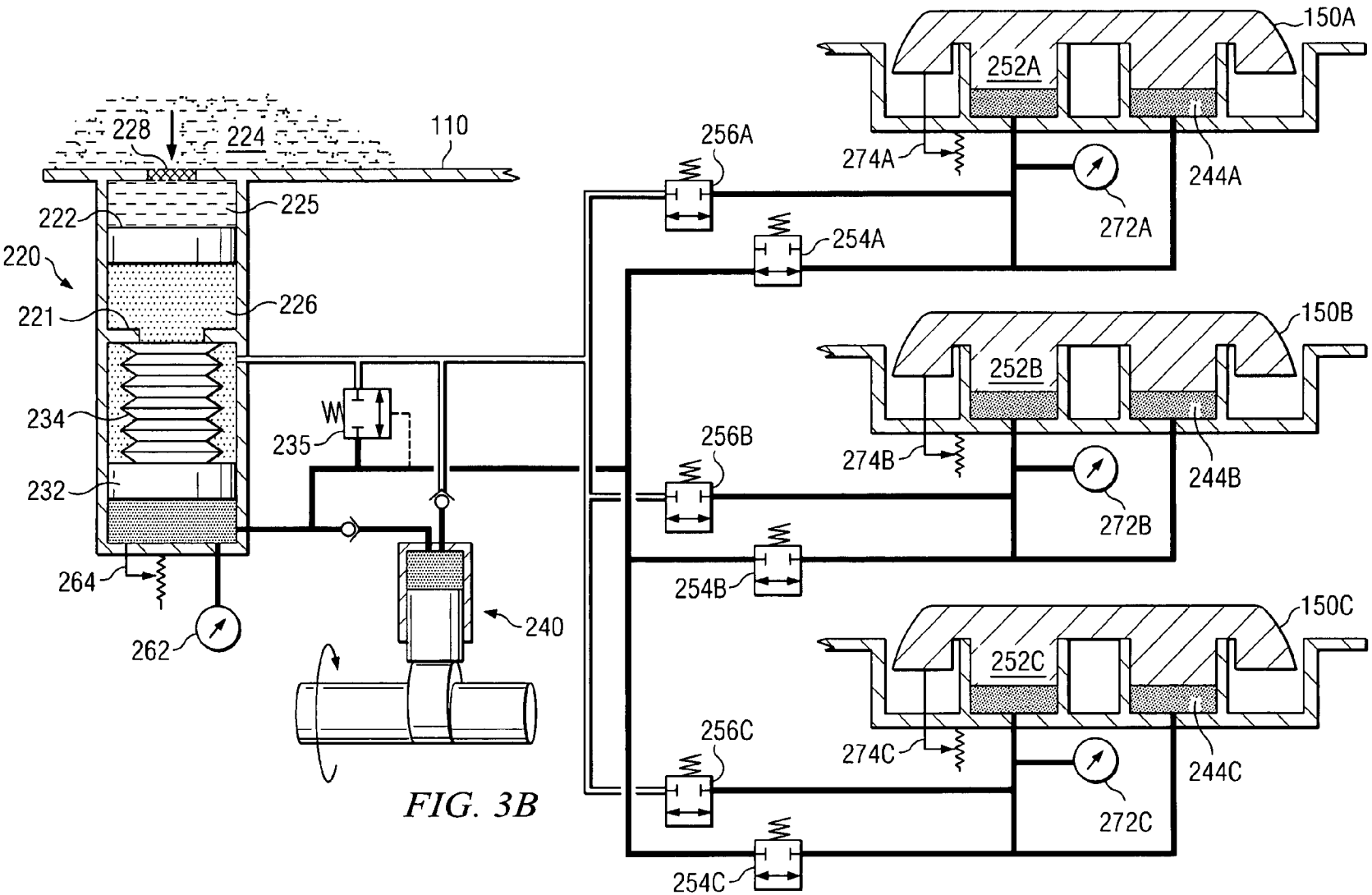

Turning now to FIG. 2, one exemplary embodiment of steering tool 100 from FIG. 1 is illustrated in perspective view. In the exemplary embodiment shown, steering tool 100 is substantially cylindrical and includes threaded ends 102 and 104 (threads not shown) for connecting with other bottom hole assembly (BHA) components (e.g., connecting with the drill bit at end 104 and upper BHA components at end 102). The steering tool 100 further includes a housing 110 and at least one blade 150 deployed, for example, in a recess (not shown) in the housing 110. Steering tool 100 further includes hydraulics 130 and electronics 140 modules (also referred to herein as control modules 130 and 140) deployed in the housing 110. In general (and as described in more detail below with respect to FIGS. 3A and 3B), the control modules 130 and 140 are configured for measuring and controlling the relative positions of the blades 150 as well as the hydraulic system and blade pressures. Control modules 130 and 140 may include substantially any devices known to those of skill in the art, such as those disclosed in U.S. Pat. No. 5,603,386 to Webster or U.S. Pat. No. 6,427,783 to Krueger et al. To steer (i.e., change the direction of drilling), one or more of blades 150 are extended and exert a force against the borehole wall. The steering tool 100 is moved away from the center of the borehole by this operation, altering the drilling path. It will be appreciated that the tool 100 may also be moved back towards the borehole axis if it is already eccentered. To facilitate controlled steering, the rotation rate of the housing is desirably less than 0.1 rpm during drilling, although the invention is not limited in this regard. By keeping the blades 150 in a substantially fixed position with respect to the circumference of the borehole (i.e., by preventing rotation of the housing 110), it is possible to steer the tool without constantly extending and retracting the blades 150. Non-rotary steerable embodiments are thus typically only utilized in sliding mode. In rotary steerable embodiments, the tool 100 is constructed so that the housing 110, which houses the blades 150, remains stationary, or substantially stationary, with respect to the borehole during directional drilling operations. The housing 110 is therefore constructed in a rotationally non-fixed (of floating) fashion with respect to a shaft 115 (FIGS. 3A and 3B). The shaft 115 is connected with the drill string and is disposed to transfer both torque and weight to the bit. It will be understood that the invention is not limited to rotary steerable embodiments.

In general, increasing the offset (i.e., increasing the distance between the tool axis and the borehole axis) tends to increase the curvature (dogleg severity) of the borehole upon subsequent drilling. In the exemplary embodiment shown, steering tool 100 includes near-bit stabilizer 120, and is therefore configured for "point-the-bit" steering in which the direction (tool face) of subsequent drilling tends to be in the opposite direction (or nearly the opposite; depending, for example, upon local formation characteristics) of the offset between the tool axis and the borehole axis. The invention is not limited to the mere use of a near-bit stabilizer. It is equally well suited for "push-the-bit" steering in which there is no near-bit stabilizer and the direction of subsequent drilling tends to be in the same direction as the offset between the tool axis and borehole axis.

With reference now to FIGS. 3A and 3B, one exemplary embodiment of hydraulic module 130 is schematically depicted. FIG. 3A is a simplified schematic of the hydraulic module 130 showing only a single blade 150A. FIG. 3B shows each of the three blades 150A, 150B, and 150C as well as certain of the electrical control devices (which are in electronic communication with electronic control module 140). Hydraulic module 130 includes a hydraulic fluid chamber 220 including first and second, low and high pressure reservoirs 226 and 236. In the exemplary embodiment shown, low pressure reservoir 226 is modulated to wellbore (hydrostatic) pressure via equalizer piston 222. Wellbore drilling fluid 224 enters fluid cavity 225 through filter screen 228, which is deployed in the outer surface of the non-rotating housing 110. It will be readily understood to those of ordinary skill in the art that the drilling fluid in the borehole exerts a force on equalizer piston 222 proportional to the wellbore pressure, which thereby pressurizes hydraulic fluid in low pressure reservoir 226.

Hydraulic module 130 further includes a piston pump 240 operatively coupled with drive shaft 115. In the exemplary embodiment shown, pump 240 is mechanically actuated by a cam 118 formed on an outer surface of drive shaft 115, although the invention is not limited in this regard. Pump 240 may be equivalently actuated, for example, by a swash plate mounted to the outer surface of the shaft 115 or an eccentric profile formed in the outer surface of the shaft 115. In the exemplary embodiment shown, rotation of the drive shaft 115 causes cam 118 to actuate piston 242, thereby pumping pressurized hydraulic fluid to high pressure reservoir 236. Piston pump 240 receives low pressure hydraulic fluid from the low pressure reservoir 226 through inlet check valve 246 on the down-stroke of piston 242 (i.e., as cam 118 disengages piston 242). On the upstroke (i.e., when cam 118 engages piston 242), piston 242 pumps pressurized hydraulic fluid through outlet check valve 248 to the high pressure reservoir 236.

It will be understood that the invention is not limited to any particular pumping mechanism. As stated above, the invention is not limited to rotary steerable embodiments and thus is also not limited to a shaft actuated pumping mechanism. In other embodiments, an electric powered pump may be utilized, for example, powered via electrical power generated by a mud turbine.

Hydraulic fluid chamber 220 further includes a pressurizing spring 234 (e.g., a Belleville spring) deployed between an internal shoulder 221 of the chamber housing and a high pressure piston 232. As the high pressure reservoir 236 is filled by pump 240, high pressure piston 232 compresses spring 234, which maintains the pressure in the high pressure reservoir 236 at some predetermined pressure above wellbore pressure. Hydraulic module 130 typically (although not necessarily) further includes a pressure relief valve 235 deployed between high pressure and low pressure fluid lines. In one exemplary embodiment, a spring loaded pressure relief valve 235 opens at a differential pressure of about 750 psi, thereby limiting the pressure of the high pressure reservoir 236 to a pressure of about 750 psi above wellbore pressure. However, the invention is not limited in this regard.

With continued reference to FIGS. 3A and 3B, extension and retraction of the blades 150A, 150B, and 150C are now described. The blades 150A, 150B, and 150C are essentially identical and thus the configuration and operation thereof are described only with respect to blade 150A. Blades 150B and 150C are referred to below in reference to exemplary hydraulic control methods in accordance with this invention. Blade 150A includes one or more blade pistons 252A deployed in corresponding chambers 244A, which are in fluid communication with both the low and high pressure reservoirs 226 and 236 through controllable valves 254A and 256A, respectively. In the exemplary embodiment shown, valves 254A and 256A include solenoid controllable valves, although the invention is not limited in this regard.

In order to extend blade 150A (radially outward from the tool body), valve 254A is opened and valve 256A is closed, allowing high pressure hydraulic fluid to enter chamber 244A. As chamber 244A is filled with pressurized hydraulic fluid, piston 252A is urged radially outward from the tool, which in turn urges blade 150A outward (e.g., into contact with the borehole wall). When blade 150A has been extended to a desired (predetermined) position, valve 254A may be closed, thereby "locking" the blade 150A in position (at the desired extension from the tool body).

In order to retract the blade (radially inward towards the tool body), valve 256A is open (while valve 254A remains closed). Opening valve 256A allows pressurized hydraulic fluid in chamber 244A to return to the low pressure reservoir 226. Blade 150A may be urged inward (towards the tool body), for example, via spring bias and/or contact with the borehole wall. In the exemplary embodiment shown, the blade 150A is not drawn inward under the influence of a hydraulic force, although the invention is not limited in this regard.

Hydraulic module 130 may also advantageously include one or more sensors, for example, for measuring the pressure and volume of the high pressure hydraulic fluid. In the exemplary embodiment shown on FIG. 3B, sensor 262 is disposed to measure hydraulic fluid pressure in reservoir 236. Likewise, sensors 272A, 272B, and 272C are disposed to measure hydraulic fluid pressure at blades 150A, 150B, and 150C, respectively. Position sensor 264 is disposed to measure the displacement of high pressure piston 232 and therefore the volume of high pressure hydraulic fluid in reservoir 236. Position sensors 274A, 274B, and 274C are disposed to measure the displacement of blade pistons 252A, 252B, and 252C and thus the extension of blades 150A, 150B, and 150C. In one exemplary embodiment of the invention, sensors 262, 272A, 272B, and 272C each include a pressure sensitive strain gauge, while sensors 264, 274A, 274B, and 274C each include a potentiometer having a resistive wiper, however, the invention is not limited in regard to the types of pressure and volume sensors utilized.

In the exemplary embodiments shown and described with respect to FIGS. 3A and 3B, hydraulic module 130 utilizes pressurized hydraulic oil in reservoirs 226 and 236. The artisan of ordinary skill will readily recognize that the invention is not limited in this regard and that pressurized drilling fluid, for example, may also be utilized to extend blades 150A, 150B, and 150C.

During a typical directional drilling application, a steering command may be received at steering tool 100, for example, via drill string rotation encoding. Exemplary drill string rotation encoding schemes are disclosed, for example, in commonly assigned, co-pending U.S. patent applications Ser. Nos. 10/882,789 and 11/062,299 (now U.S. Pat. Nos. 7,245,229 and 7,222,681). Upon receiving the steering command (which may be, for example, in the form of transmitted offset and tool face values), new blade positions are typically calculated and each of the blades 150A, 150B, and 150C is independently extended and/or retracted to its appropriate position (as measured by displacement sensors 274A, 274B, and 274C). Two of the blades (e.g., blades 150B and 150C) are preferably locked into position as described above (valves 254B, 254C, 256B, and 256C are closed). The third blade (e.g., blade 150A) preferably remains "floating" (i.e., open to high pressure hydraulic fluid via valve 256A) in order to maintain a grip on the borehole wall so that housing 110 does not rotate during drilling.

During drilling, the wellbore typically penetrates numerous strata and boundaries between those strata. When drilling through certain types of formations or when drilling from one formation type to another (e.g., through a bed boundary), a significant increase in drag (frictional force between the blades and the borehole wall) is sometimes observed. Excessive drag hinders the blades from sliding downward along the borehole wall and can significantly slow (or even stop) the rate of penetration during drilling. In some cases the drag can become so great that it becomes essentially impossible to move the drill string down the borehole with the blades extended. One way to overcome this difficulty has been to collapse (retract) the blades, which substantially eliminates the drag force and allows weight to be transferred to the drill bit. The blades may then be reset to their former positions to resume directional drilling. This approach is often serviceable, but tends to waste valuable rig time (due to the time spent collapsing and resetting the blades). It also does nothing to prevent (or discourage) excessive friction from reoccurring.

It has been observed that the onset of drag (blade friction) correlates with increasing hydraulic pressure in the locked blades (e.g., blades 150B and 150C described above). Increased blade pressure, and the associated blade friction, has been observed to occur, for example, when drilling through a relatively soft formation into a relatively hard formation. As is known to those of ordinary skill in the art, the borehole diameter in a hard formation tends to be less than that in a soft formation (owing, for example, to reduced washout of the hard formation). Forcing the steering tool into the smaller diameter section of the borehole tends to exert an inward force on the blades. While the use of a floating blade (e.g., blade 150A) is intended to accommodate such changes in borehole diameter, hydraulic pressure in the locked blades has been observed in certain instances to increase to nearly 1,000 psi above the pressure in high pressure reservoir 236 (e.g., to about 1,700 psi above wellbore pressure). Not only do such pressures cause excessive drag (friction), they also tend to damage seals and other critical hydraulic components. As such, there is a need for a method of controlling the hydraulic pressure in the locked blades during drilling.

Figure 4:
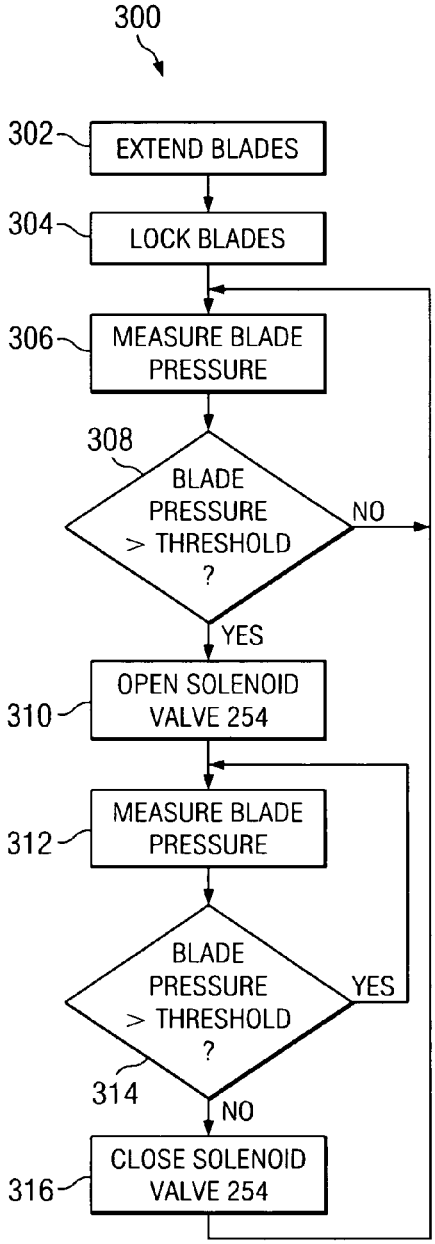
FIG. 4 depicts one exemplary method embodiment of the present invention in flowchart form.

With reference now to FIG. 4, a flow chart of a blade pressure control method 300 in accordance with this invention is shown. At 302 the blades are individually extended to predetermined positions as described above. At least one of the blades (e.g., blades 150B and 150C) is then locked at its predetermined position at 304 as also described above. For clarity of exposition, method 300 will be described only with respect to blade 150B. It will be understood that in practice the method most often involves simultaneous control of the hydraulic pressure in two locked blades (e.g., blades 150B and 150C). Notwithstanding, the invention is not limited in these regards. Blade 150B may be locked, for example, by closing valves 254B and 256B. At 306 and 308, the hydraulic fluid pressure at the blade 150B is measured (e.g., via pressure sensor 272B) and compared with a first predetermined threshold (e.g., 1,000 psi above wellbore pressure). If the pressure is less than the threshold, the controller waits for a predetermined time (e.g., 1 second) before repeating steps 306 and 308. If the pressure is greater than the threshold, valve 254B is opened, thereby coupling the hydraulic fluid in chamber 244B with that in the high pressure reservoir 236. After a predetermined time (e.g., 1 second), the blade pressure is measured again and compared with a second predetermined threshold at 312 and 314. If the blade pressure is less than or equal to the second threshold, valve 254B is closed and the controller returns to step 306 at which the blade pressure is again measured after some predetermined time. If the blade pressure remains greater than the second threshold, valve 254B is left open and the controller waits for a predetermined time before repeating steps 312 and 314.

It may be advantageous in certain embodiments of method 300 to allow a "hysteresis" in the blade pressure to reduce the frequency of valve actuation. This may be accomplished, for example, by using a first threshold in step 308 that is greater than the second threshold in step 314. In one such embodiment, the first threshold may be equal to about 1,000 psi above wellbore pressure while the second threshold may be equal to about 900 psi above wellbore pressure. In such an exemplary embodiment, valve 254B is not opened until the blade pressure exceeds 1,000 psi. Once open, the valve 254B is not closed until the blade pressure drops below 900 psi. The artisan of ordinary skill in the art will readily appreciate that this 100 psi "hysteresis" tends to advantageously reduce the frequency of valve actuation. A hysteresis may also be achieved by implementing a time delay between steps 310 and 312. For example, even when the first and second thresholds are equal, a delay of about one second or more tends to provide sufficient hysteresis (i.e., the blade pressure is sufficiently reduced below the threshold to reduce the frequency of valve actuation).

It will be appreciated that the blade pressure may also be reduced by opening valve 256B. However, while suitably reducing blade pressure, opening valve 256B also tends to result in an inward retraction of the blade (as described above). Such an action would tend to change the offset and toolface settings of the steering tool, which could possibly alter the steering direction. The intent of method 300 is to control hydraulic pressure in the blade (i.e., in chamber 244B) while the blade remains locked in the predetermined position established at step 302. By "locked" it will be understood that the radial position of the blade is substantially unchanged, despite the above described change in blade pressure. Reduction of the blade pressure reduces the friction on the borehole wall by reducing the axial force of the blade on the wall. However, since the hydraulic fluid is substantially incompressible, the radial position of the blade remains substantially unchanged (and the blade remains locked in position). Opening valve 254B, as described above with respect to FIG. 4, is advantageously intended to (and has been observed to) reduce blade pressure towards system pressure (thereby reducing drag) without decompressing the blade to wellbore pressure (which would likely cause blade retraction).

It has also been observed that the blades can sometimes be damaged during reaming and/or back-reaming operations. The radial forces exerted on the blades can be extremely high, for example, during a typical back-reaming operation. Thus, it may be advantageous in certain applications to "float" all three blades (i.e., by opening valves 254A, 254B, and 254C) prior to back-reaming to accommodate the potentially high and damaging radial forces. This may be accomplished, for example, by sensing certain BHA conditions indicative of a back-reaming operation. In one exemplary embodiment, the steering tool 100 may be disposed to "float" the blades whenever the weight-on-bit is negative (indicating that the drill bit has been lifted off bottom).

Figure 5:
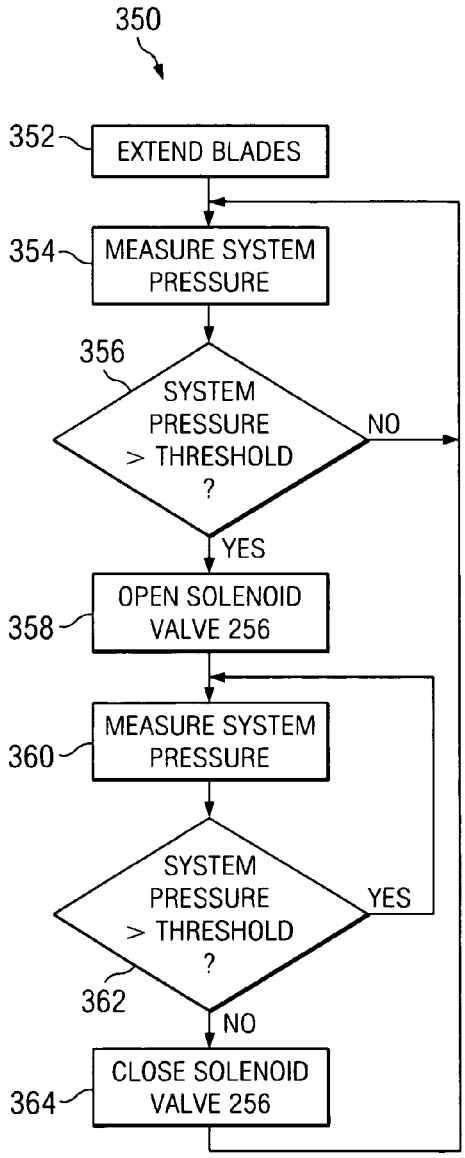
FIG. 5 depicts another exemplary method embodiment of the present invention in flowchart form.

With reference now to FIG. 5, a flow chart of a system pressure control method 350 in accordance with this invention is shown. It has been found that less force is required to steer (i.e., achieve a desired offset) in certain tool configurations. For example, less force is typically required in push-the-bit configurations, in which no near-bit stabilizer is utilized, than in point-the-bit configurations in which a near-bit stabilizer is used (e.g., as shown on FIG. 2). It will be appreciated that in point-the-bit configurations sufficient force is required to bend the housing and thereby steer the bit. Much less bending of the housing (and therefore less force) is generally required in push-the-bit configurations. The orientation and profile of the borehole also influence how much force is required to steer the tool 100. For example, less force is required to drill a relatively straight section than is required to drill a section having a severe dogleg. Additionally, less force is typically required at low borehole inclinations (e.g., less than about 45 degrees). As is well known in the art, many drilling applications begin with a vertical section (near-zero inclination) and build to horizontal or near-horizontal (an inclination of about 90 degrees). In such applications a steering tool having a controllable system pressure (the pressure in reservoir 236) would be advantageous. For example, a low system pressure may be utilized at low inclinations in order to reduce the radial force of the blades on the borehole wall. This would tend to advantageously minimize drag and increase the rate of penetration. At higher inclinations the system pressure may be increased such that the radial force of the blades on the borehole wall is sufficient to steer (achieve the desired offset).

Method 350 is similar to method 300 in that it requires measuring a hydraulic fluid pressure and comparing the measured pressure to one or more predetermined threshold values. In the exemplary embodiment shown on FIG. 5, blades 150A, 150B, and 150C are extended at 352. For clarity of exposition, method 350 will be described for a tool configuration in which blade 150A is floating and blades 150B and 150C are locked in their predetermined positions (as described above). The invention is, of course, not limited in this regard. At 354 and 356, the system pressure (the pressure in reservoir 236) is measured (e.g., via pressure sensor 262) and compared with a first predetermined threshold (e.g., 500 psi above wellbore pressure). If the pressure is less than the threshold, the controller waits for a predetermined time (e.g., 1 second) before repeating steps 354 and 356. If the pressure is greater than the threshold, valve 256A is opened at step 358. Since blade 150A is a floating blade, valve 254A remains open to high pressure hydraulic fluid in reservoir 236. Thus, opening valve 256A at step 358 essentially "short circuits" the high pressure reservoir 236 with low pressure reservoir 226. After a predetermined time (e.g., 1 second), the blade pressure is measured again and compared with a second predetermined threshold at 360 and 362. If the system pressure is less than or equal to the second threshold, valve 256A is closed and the controller returns to step 354 at which the system pressure is again measured after some predetermined time. If the system pressure remains greater than the second threshold, valve 256A is left open and the controller waits for a predetermined time before repeating steps 360 and 362.

As described above with respect to method 300 (FIG. 4), it may be advantageous in certain embodiments of method 350 to allow a "hysteresis" to the system pressure to reduce the frequency of valve actuation. This may be accomplished, for example (as described above), by using a first threshold in step 356 that is greater than the second threshold in step 362 (e.g., a difference between the first and second thresholds of 100 psi). As also described above, a hysteresis may also be achieved by implementing a time delay between steps 358 and 360. For example, even when the first and second thresholds are equal, a delay of one second or more tends to provide sufficient hysteresis (i.e., the system pressure is sufficiently reduced below the threshold to reduce the frequency of valve actuation).

It will be appreciated that the system pressure may also be controlled via implementing a controllable system valve (e.g., a solenoid valve) in place of (or in parallel with) pressure relieve valve 235. In this tool configuration, steps 358 and 364 would respectively open and close the system valve. In a configuration in which the system valve replaces pressure relief valve 235, the system pressure may be controlled over substantially any suitable range of pressures.

It will also be appreciated that pressure.control methods 300 and 350 (FIGS. 4 and 5) may be implemented in substantially any suitable manner. Moreover, methods 300 and 350 may be run individually (e.g., method 300 alone) or simultaneously. A drilling operator may transmit a desired pressure control mode to the steering tool 100 via substantially any suitable method, for example, via drill string rotation encoding. The invention is not limited in this regard. Exemplary drill string rotation encoding schemes arc disclosed, for example, in commonly assigned, U.S. patent applications Ser. Nos. 10/882,789 and 11/062,299 (now U.S. Pat. Nos. 7,245,229 and 7,222,681). In one exemplary embodiment, the pressure control mode is selected via transmitting two drill string rotation rate pulses. The first pulse indicates what type of command is being transmitted. For example, a rotation rate pulse having an amplitude of at least 70 rpm above a baseline rotation rate and a duration in the range from three minutes 30 seconds to four minutes indicates a pressure control command (as opposed to other types of steering tool commands). The second pulse indicates the selected pressure control mode. For example, as shown in Table 1, the duration of the second pulse may be utilized to encode the pressure control mode.

TABLE 1

| Pressure Control Mode | Pulse Duration (second pulse) |
|---|---|
| No Pressure Control | 3 min-3 min 30 sec |
| Blade Pressure Control | 1 min 30 sec-2 min |
| System Pressure Control | 2 min-2 min 30 sec |
| Blade and System Control | 2 min 30 sec-3 min |

After selecting the pressure control mode (e.g., both blade and system pressure control), the desired pressure thresholds may be transmitted to the steering tool 100 (e.g., via another drill string rotation rate pulse). In one exemplary embodiment, the previously utilized thresholds may be utilized. The pressure threshold values may be changed in any suitable manner. For example, the pressure thresholds may be selected from a menu, such as blade pressure thresholds of 800, 1000, or 1200 psi above wellbore pressure and system pressure thresholds of 450, 600, and 750 psi above wellbore pressure. Numeric thresholds may also be transmitted directly to the steering tool 100 (e.g., in binary form). Alternatively, the pressure thresholds may be toggled upwards or downwards (e.g., in increments of 50 or 100 psi). The invention is not limited in these regards.

Figure 6:
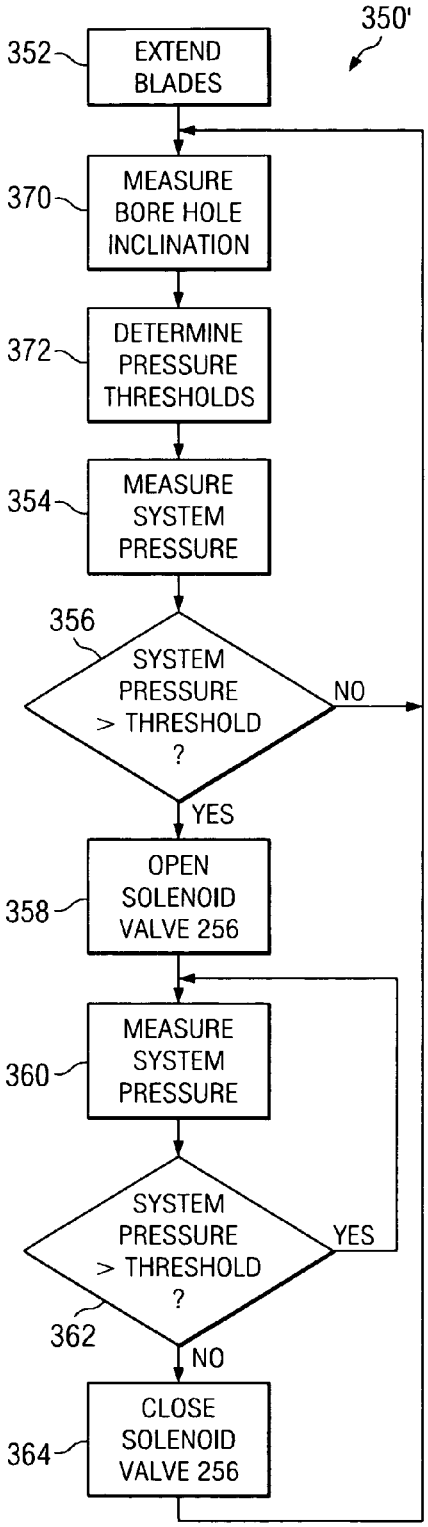
FIG. 6 depicts the exemplary method embodiment shown on FIG. 5 further including a rule-based intelligence scheme for determining a pressure threshold.

Exemplary pressure control methods of the present invention may also incorporate rule-based intelligence. Such "smart" control systems may be configured to control system and/or blade hydraulic pressures based on drilling performance and/or other steering tool measurements (such as borehole inclination). In one exemplary embodiment, pressure control method 350 (FIG. 5) may be modified as shown on FIG. 6. Method 350' is identical to method 350 with the exception of added steps 370 and 372. At 370, steering tool 100 measures the borehole inclination. At 372, the borehole inclination is processed to determine the first and second pressure thresholds. It will be appreciated that the pressure thresholds may be determined from the borehole inclination using substantially any suitable algorithm. For example, the pressure thresholds may be determined from a look-up table such as that shown in Table 2. Alternatively, they may be calculated from a mathematical equation expressing the pressure thresholds as a function of borehole inclination. The invention is not limited in this regard.

TABLE II

| Borehole Inclination | First Threshold Value | Second Threshold Value |
|---|---|---|
| 0-30 degrees | 400 psi | 500 psi |
| 30-60 degrees | 500 psi | 600 psi |
| 60-80 degrees | 600 psi | 700 psi |
| 80-100 degrees | 700 psi | 800 psi |

It will be appreciated that other borehole, formation, and/or steering tool measurements may be utilized alternatively and/or additionally to borehole inclination. For example, in another exemplary embodiment, method 350' may be modified so that the steering tool also measures the gravity tool face of housing 110 at step 370. A change in the measured tool face with time typically indicates that the housing 110 is rotating (slipping) in the borehole and that the blades do not have a suitable grip on the borehole wall to prevent such rotation. A measured change in tool face at 370 may then be utilized to increase the threshold pressures at 372. For example, in a near-vertical borehole (where the inclination is less than 30 degrees), a change in tool face may prompt the processor to increase the first and second pressure thresholds from 400 and 500 psi to 500 and 600 psi.

In still another exemplary embodiment, the frictional force of the blades on the borehole wall may be measured directly and used as an alternative and/or additional control parameter in method 350'. For example, conventional strain gauges may be deployed above and below blade housing 110 (FIG. 2) and utilized to measure the near-bit weight-on-bit at both locations. It will be understood that the difference between the two weight-on-bit measurements (the weight supported by the blades) is directly proportional to the frictional force of the blades on the borehole wall. In one exemplary pressure control method, the system pressure may be controlled so that the weight-on-bit loss at the blades (the difference between the two weight-on-bit measurements) remains in some predetermined range (e.g., 3000 to 6000 pounds). Thus, for example, in method 350', the pressure thresholds may be increased if the weight-on-bit loss is less than the predetermined range and decreased when the weight-on-bit loss is greater than the predetermined range. The artisan of ordinary skill will readily recognize that weight-on-bit loss may be used alone or in combination with other measurements (e.g., inclination and tool face).

It will be appreciated that numerous other borehole and/or tool parameters may be utilized in rule-based-intelligence control methods in accordance with this invention. For example pressure thresholds may also be determined based on various measured parameters such as borehole caliper, borehole curvature, LWD formation measurements, bending moments, hydraulic fluid pressure fluctuations, BHA vibration, and the like. Borehole curvature may be determined, for example, from longitudinally spaced inclination and/or azimuth measurements (e.g., at first and second longitudinal positions on the drill string) as disclosed in commonly assigned, co-pending U.S. Patent application Ser. No. 10/862,739 (now U.S. Pat. 7,245,229). Predetermined build rates, turn rates. DLS, and steering tool offset (the predetermined distance between the center of the borehole and the tool axis) may also utilized to determine pressure thresholds. LWD formation measurements may be used, for example, to identify known formations in which frictional forces tend to be excessive. Exemplary LWD measurements include, for example, formation density, resistivity, and various sonic velocities (also refeired to reciprocally as slownesses).

Bending moments may be measured, for example, by deploying a conventional strain gauge on the shaft (or a flexible sub in the BHA). It will be understood that the bending moment is typically directly proportional to the blade force required to alter the drilling direction (excluding the blade force required due to the gravitational force). The artisan of ordinary skill will readily recognize that the combination of the required bending force and the gravitational force applied to the BHA may be used to derive the minimum force required for the blades. In other exemplary embodiments, achieved or predetermined tool offset values may be used to estimate the required bending moment and therefore the required blade force.

Figure 7:
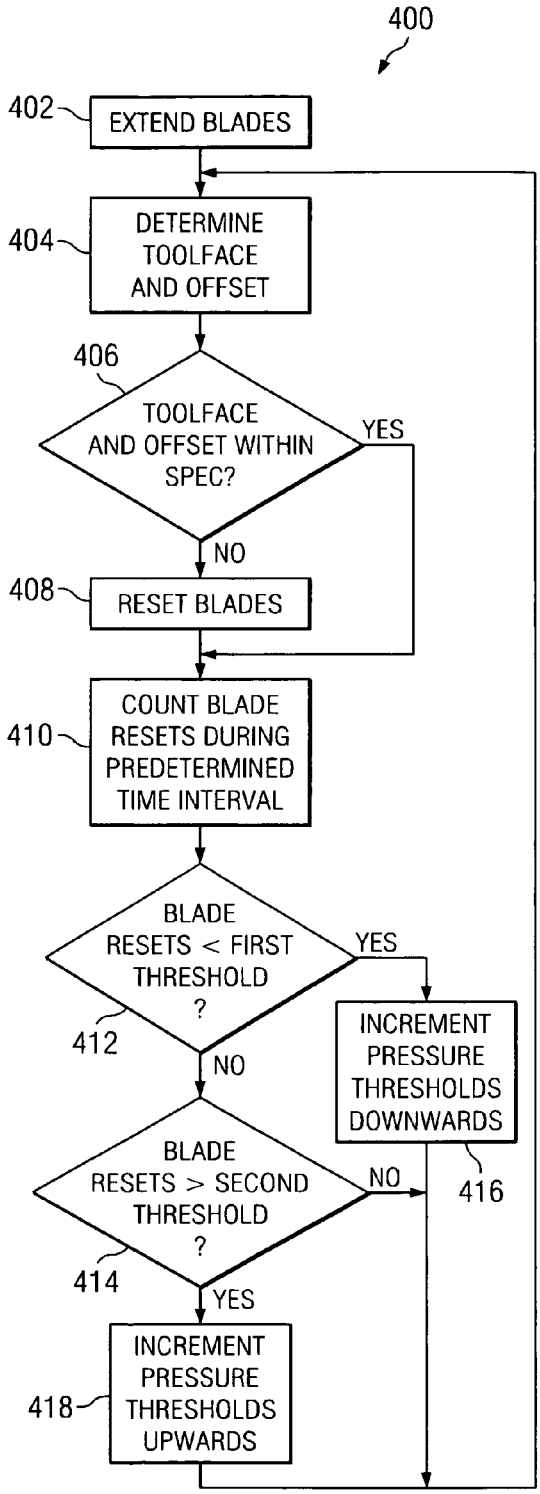
FIG. 7 depicts another exemplary method embodiment of the present invention employing rule-based intelligence to determine a pressure threshold.

With reference now to FIG. 7, a flow chart of an alternative embodiment of a closed-loop control method 400 in accordance with the present invention is illustrated. In this particular embodiment, a measure of the steerability and drillability of the steering tool may be used to increment the pressure thresholds upward and/or downward (e.g., the first and second pressure thresholds utilized in methods 300 and 350). At 402 the blades 150A, 150B, and 150C are extended (and/or retracted) to predetermined positions (which as described above may be calculated from predetermined tool face and offset values). At 404 and 406 the actual tool face and offset of the steering tool are measured and compared with the predetermined values. As is known to those of ordinary skill in the art, the tool face and offset may be determined, for example, as follows. First, the displacement of each of the blades 150A, 150B, and 150C is measured (e.g., via sensors 274A, 274B, and 274C, respectively). From the blade displacement measurements, a borehole caliper may be determined and utilized to locate the center of the borehole (e.g., assuming a circular borehole). The center location of the tool may also be determined from the blade displacement measurements (as is known to those of ordinary skill in the art). The offset and tool face are then calculated from the two center locations. The offset is defined as the distance between the center locations and the tool face is defined as the angular direction of the offset (tool face and offset thus define an eccentricity vector for the tool in the borehole). With reference again to step 406, if the measured tool face and offset values are outside of a predefined specification of the predetermined tool face and offset values, then the blade positions are recalculated and reset at 408.

With continued reference to FIG. 7, the number of blade resets during a predetermined time interval is counted at 410 (e.g., the number of blade resets in the previous five minutes). If the reset frequency is less than a first predetermined threshold (e.g., less than four resets in five minutes) at 412, then the pressure thresholds (which may be utilized in methods 300 and 350, for example) are incremented downward (e.g., in 50 or 100 psi increments) at step 416. If reset frequency is greater than a second predetermined threshold (e.g., greater than six resets in five minutes) at 414, then the pressure thresholds are incremented upward (e.g., in 50 or 100 psi increments) at 418. The method then returns to step 404 and after a predetermined time interval (e.g., 1 second) measures the tool face and offset as described above.

It will be appreciated that in certain exemplary embodiments it may be advantageously to include upper and lower limits on the threshold pressures. For example, in one exemplary embodiment, the blade pressures may be controlled within a range from about 500 to about 1400 psi, while the system pressure may be controlled in a range from about 300 to about 750 psi.

It will also be appreciated that method 400 advantageously controls the system and/or blade pressures based on the performance of the steering tool 100. When the steering tool is performing well (achieving the desired tool face and offset values with a relatively low frequency of blade resets), the system and/or blade pressures may be lowered. As described above, lower the system and/or blade pressures advantageously reduces drag on the borehole wall and tends to increase the rate of penetration. Reducing system and/or blade pressures also tends to lengthen the service life of the hydraulic module 130 (e.g., by reducing stress on the seals). When the number of blade resets increases (e.g., indicating that housing 110 is slipping in the borehole or that the tool is unable to achieve the desired offset), system and/or blade pressures may be increased.

With reference again to FIG. 2, electronics module 140 includes a digital programmable processor such as a microprocessor or a microcontroller and processor-readable or computer-readable programming code embodying logic, including instructions for controlling the function of the steering tool 100. Substantially any suitable digital processor (or processors) may be utilized, for example, including an ADSP-2191M microprocessor, available from Analog Devices, Inc.

Electronics module 140 is disposed, for example, to execute pressure control methods 300, 350, 350' and/or 400 described above. In the exemplary embodiments shown, module 140 is in electronic communication with pressure sensors 262, 272A, 272B, 272C and displacement sensors 264, 274A, 274B, 274C. Electronic module 140 may further include instructions to receive rotation and/or flow rate encoded commands from the surface and to cause the steering tool 100 to execute such commands upon receipt. Module 140 typically further includes at least one tri-axial arrangement of accelerometers as well as instructions for computing gravity tool face and borehole inclination (as is known to those of ordinary skill in the art). Such computations may be made using either software or hardware mechanisms (using analog or digital circuits). Electronic module 140 may also further include one or more sensors for measuring the rotation rate of the drill string (such as accelerometer deployments and/or Hall-Effect sensors) as well as instructions executing rotation rate computations. Exemplary sensor deployments and measurement methods are disclosed, for example, in commonly assigned, co-pending U.S. patent application Ser. Nos. 11/273,692 and 11/454,019.

Electronic module 140 typically includes other electronic components, such as a timer and electronic memory (e.g., volatile or non-volatile memory). The timer may include, for example, an incrementing counter, a decrementing time-out counter, or a real-time clock. Module 140 may further include a data storage device, various other sensors, other controllable components, a power supply, and the like. Electronic module 140 is typically (although not necessarily) disposed to communicate with other instruments in the drill string, such as telemetry systems that communicate with the surface and an LWD tool including various other formation sensors. Electronic communication with one or more LWD tools may be advantageous, for example, in geo-steering applications. One of ordinary skill in the art will readily recognize that the multiple functions performed by the electronic module 140 may be distributed among a number of devices.

Although the present invention and its advantages have been described in detail, it should be understood that various changes, substitutions and alternations can be made herein without departing from the spirit and scope of the invention as defined by the appended claims.

We claim:

1. A downhole steering tool configured to operate in a borehole, the steering tool comprising:

a plurality of blades deployed on a housing, the blades disposed to extend radially outward from the housing and engage a wall of the borehole, said engagement of the blades with the borehole wall operative to eccenter the housing in the borehole;

a hydraulic module including (i) a plurality of valves, (ii) a fluid chamber disposed to provide high pressure fluid to each of the plurality of blades, and (iii) at least one pressure sensor disposed to measure a pressure in the fluid chamber, the high pressure fluid operative to extend the blades;

a controller disposed to (i) receive pressure measurements from the sensor and (ii) regulate the pressure in the fluid chamber via short circuiting the high pressure fluid with low pressure fluid through one of the blades, said short circuiting accomplished via opening at least one of the valves in response to said pressure measurements.

2. The steering tool of claim 1, wherein:

each of the blades includes at least a corresponding first valve in fluid communication with the high pressure fluid and at least a corresponding second valve in fluid communication with low pressure fluid; and the controller is disposed to regulate the pressure in the fluid chamber via opening the corresponding second valve in at least one of the blades.

3. The steering tool of claim 2, wherein the controller is further disposed to reduce a pressure in at least one of the blades via actuating the corresponding first valve.

4. The steering tool of claim 1, further comprising a shaft disposed to rotate substantially freely in the housing.

5. The steering tool of claim 4, further comprising a piston pump operatively coupled with the shaft, the pump disposed fill the fluid chamber with high pressure hydraulic fluid upon rotation of the shaft relative to the housing.

6. A downhole steering tool configured to operate in a borehole, the steering tool comprising:

a plurality of blades deployed on a housing, the blades disposed to extend radially outward from the housing and engage a wall of the borehole, said engagement of the blades with the borehole wall operative to eccenter the housing in the borehole;

a hydraulic module including a plurality of valves, a fluid chamber disposed to provide pressurized fluid to each of the plurality of blades, the pressurized fluid operative to extend the blades, each of the blades including at least a first valve in fluid communication with high pressure fluid and at least a second valve in fluid communication with low pressure fluid, each of the blades further including a pressure sensor disposed to measure a fluid pressure in the blade;

a controller disposed (i) to lock at least one of the blades in a predetermined radially extended position by closing both the corresponding first and second valves (ii) to receive pressure measurements from the pressure sensors and (iii) reduce the pressure in at least one of said locked blades via opening at least one of the corresponding first and second valves when the measured pressure is greater than a threshold pressure.

7. The steering tool of claim 6, wherein the controller is disposed to (ii) reduce the pressure in at least one of the blades via opening the corresponding first valve when the measured pressure is greater than a threshold pressure.

8. The steering tool of claim 6, wherein the controller is further disposed to (iii) reduce the pressure in the fluid chamber via opening the corresponding second valve in at least one of the blades.

9. The steering tool of claim 6, further comprising:

a shaft disposed to rotate substantially freely in the housing; and a piston pump operatively coupled with the shaft, the pump disposed to fill the fluid chamber with high pressure hydraulic fluid upon rotation of the shaft relative to the housing.

10. A closed loop method for regulating hydraulic pressure in a downhole steering tool, the steering tool including a plurality of blades deployed in a housing, the blades disposed to extend radially outward from the housing and engage a wall of the borehole, said engagement of the blades with the borehole wall operative to eccenter the housing in the borehole, the steering tool further including a fluid chamber disposed to provide high pressure fluid to each of the plurality of blades, the high pressure fluid operative to extend the blades, the method comprising:

(a) deploying the steering tool in a subterranean borehole;

(b) extending each of the blades to a corresponding predetermined radial position;

(c) measuring a pressure of fluid in the fluid chamber;

(d) comparing the pressure measured in (c) with a predetermined pressure threshold;

(e) opening at least one valve when the pressure measured in (c) is greater than the predetermined pressure threshold such that high pressure fluid is short circuited with low pressure fluid through at least one of the blades.

11. The method of claim 10, further comprising:

(f) closing the at least one valve when the pressure measured in (c) is less than the predetermined pressure threshold.

12. The method of claim 10, wherein:

(d) comprises comparing the hydraulic pressure measured in (c) with predetermined first and second pressure thresholds;

(e) comprises opening at least one valve when the hydraulic pressure measured in (c) is greater than the first predetermined pressure threshold; and the method further comprises (f) closing the at least one valve when the hydraulic pressure measured in (c) is less than the second predetermined pressure threshold.

13. The method of claim 10, wherein:

each of the blades includes at least a first valve in fluid communication with high pressure fluid in the fluid chamber and at least a second valve in fluid communication with low pressure fluid; and (e) further comprises opening the first and second valves when the pressure measured in (c) is greater than the predetermined pressure threshold.

14. A closed-loop method for regulating hydraulic pressure at a locked blade in a downhole steering tool, the steering tool including a plurality of blades deployed on the housing, the blades disposed to extend radially outward from the housing and engage a wall of the borehole, said engagement of the blades with the borehole wall operative to eccenter the housing in the borehole, each of the blades including at least a first valve in fluid communication with high pressure fluid and at least a second valve in fluid communication with low pressure fluid, each of the blades further including a corresponding pressure sensor disposed to measure a fluid pressure in the blade;

the method comprising:

(a) deploying the steering tool in a subterranean borehole;

(b) extending each of the blades to a corresponding predetermined radial position;

(c) locking at least one of the blades at the predetermined radial position by closing the corresponding first and second valves;

(d) measuring the fluid pressure at one or more of said locked blades via the corresponding pressure sensor;

(e) comparing the fluid pressure measured in (d) with a predetermined pressure threshold;

(f) opening at least one of the corresponding first and second valves when the fluid pressure measured in (d) is greater than the predetermined pressure threshold.

15. The method of claim 14, wherein (f) comprises opening the corresponding first valve when the fluid pressure measured in (d) is greater than the predetermined pressure threshold.

16. The method of claim 14, further comprising:

(g) closing the at least one of the corresponding first and second valves when the fluid pressure measured in (d) is less than the predetermined pressure threshold.

17. The method of claim 14, wherein:

(c) comprises comparing the fluid pressure measured in (d) with predetermined first and second pressure thresholds;

(f) comprises opening the corresponding first valve when the fluid pressure measured in (d) is greater than the first predetermined pressure threshold; and closing the corresponding first valve when the fluid pressure measured in (d) is less than the second predetermined pressure threshold.

18. A closed-loop method for regulating hydraulic pressure in a downhole steering tool, the steering tool including a plurality of blades deployed on the housing, the blades disposed to extend radially outward from the housing and engage a wall of the borehole, said engagement of the blades with the borehole wall operative to eccenter the housing in the borehole, the steering tool further including a hydraulic module operative to extend the blades, the method comprising:

(a) deploying the steering tool in a subterranean borehole;

(b) extending each of the blades to a corresponding predetermined radial position;

(c) receiving at least one control parameter, the control parameter a member of the group consisting of borehole parameters and steering tool parameters;

(d) processing the control parameter measured in (c) to determine at least one pressure threshold;

(e) measuring a fluid pressure in the hydraulic module;

(f) comparing the fluid pressure measured in (e) with the pressure threshold determined in (d);

(g) opening at least one valve when the when the fluid pressure measured in (e) is greater than the pressure threshold determined (d) such that high pressure fluid is short circuited with low pressure fluid through at least one of the blades.

19. The method of claim 18, wherein:

the borehole parameters are selected from the group consisting of borehole inclination, borehole azimuth, borehole diameter, borehole curvature, formation resistivity, formation density, and a formation sonic velocity;

the steering tool parameters are selected from the group consisting of tool face, offset, blade friction, bending moment, predetermined offset, BHA vibration, blade reset frequency, and hydraulic fluid pressure fluctuations.

20. The method of claim 18, further comprising:

(h) closing the at least one valve when the fluid pressure measured in (e) is less than at least one of the pressure thresholds determined in (d).

21. The method of claim 18, wherein:

(d) comprises determining at least first and second pressure thresholds;

(f) comprises comparing the fluid pressure measured in (e) with at least the first and second pressure thresholds determined in (d);

(g) comprises opening at least one valve when the hydraulic pressure measured in (e) is greater than the first pressure threshold; and the method further comprises (h) closing the at least one valve when the hydraulic pressure measured in (e) is less than the second pressure threshold.

22. The method of claim 18, wherein:

the steering tool further comprises a fluid chamber disposed to provide high pressure fluid to each of the plurality of blades, the high pressure fluid operative to extend the blades;

(e) comprises measuring a fluid pressure in the fluid chamber; and opening the at least one valve in (g) decreases the fluid pressure in the fluid chamber.

23. The method of claim 18, wherein:

each of the blades includes at least a first valve in fluid communication with high pressure fluid and at least a second valve in fluid communication with low pressure fluid, each of the blades further including a corresponding pressure sensor disposed to measure a fluid pressure in the blade;

(b) further comprises locking at least one of the blades at the predetermined radial position by closing the corresponding first and second valves;

(c) comprises measuring the fluid pressure at one or more of said locked blades via the corresponding pressure sensor; and (g) comprises opening the corresponding first valve when the fluid pressure measured in (e) is greater than the predetermined pressure threshold.

24. A closed-loop method for regulating hydraulic pressure in a downhole steering tool, the steering tool including a plurality of blades deployed on the housing, the blades disposed to extend radially outward from the housing and engage a wall of the borehole, said engagement of the blades with the borehole wall operative to eccenter the housing in the borehole, the steering tool further including a hydraulic module operative to extend the blades, the method comprising:

(a) deploying the steering tool in a subterranean borehole;

(b) extending each of the blades to a corresponding predetermined radial position;

(c) measuring a tool face and an offset of the steering tool in the subterranean borehole;

(d) comparing the tool face and offset measured in (c) with predetermined tool face and offset values;

(e) resetting the blades to a set of new radial positions when the tool face and offset measured in (c) are our of specification with the predetermined tool face and offset values;

(f) determining a blade reset frequency;

(g) incrementing at least one pressure threshold downward when the blade reset frequency determined in (f) is less than a predetermined first frequency threshold; and (h) using the pressure threshold from (g) to regulate a hydraulic pressure in the hydraulic module.

25. The method of claim 24, wherein (g) further comprises incrementing the at least one pressure threshold upward when the blade reset frequency determined in (f) is greater than a predetermined second frequency threshold.

* * * * *